United States Patent [19]

Anderson

[11] Patent Number: 4,932,863

[45] Date of Patent: Jun. 12, 1990

[54] HEAT LOSS REDUCTION IN ROTATING DRUM DRYERS

[76] Inventor: Russell W. Anderson, 183 Youngs Rd., Mahwah, N.J. 07430

[21] Appl. No.: 323,380

[22] Filed: Mar. 13, 1989

Related U.S. Application Data

[63] Continuation-in-part of Ser. No. 96,740, Sep. 14, 1987, Pat. No. 4,815,969.

[51] Int. Cl.[5] ..... F27B 7/24

[52] U.S. Cl. ..... 432/115; 432/116; 432/234

[58] Field of Search ..... 432/103, 105, 114, 116, 432/234, 235, 246, 115

[56] References Cited

U.S. PATENT DOCUMENTS

| | | | |
|---|---|---|---|
| 2,266,396 | 12/1941 | Lincoln et al. | 432/115 |
| 2,749,107 | 6/1956 | Corristen | 432/234 |
| 3,008,701 | 11/1961 | Wiseman | 432/116 |
| 3,940,239 | 2/1976 | Rossi et al. | 432/115 |
| 4,071,311 | 1/1978 | Errington | 432/234 |
| 4,170,451 | 10/1979 | Luff | 432/234 |
| 4,370,128 | 1/1983 | Chielens et al. | 432/115 |
| 4,450,872 | 5/1984 | Orcutt | 432/234 |
| 4,522,587 | 6/1985 | Miller | 432/114 |
| 4,539,055 | 9/1985 | Orcutt | 432/234 |
| 4,589,354 | 5/1986 | Faehnle | 432/115 |

*Primary Examiner*—Henry C. Yuen

*Attorney, Agent, or Firm*—Samuelson & Jacob

[57] ABSTRACT

A drum dryer for use in the manufacture of bituminous concrete asphalt is provided with a jacket including a layer of ceramic fiber insulation bonded too an outer sheath of aluminum, the jacket being wrapped the outer peripheral surface of the wall of the drum and secured in place with bands of stainless steel strapping so as to reduce to a minimum heat loss due to dissipation of heat from the outer peripheral surface of the drum wall, thereby enabling conservation of energy, while affording protection to personnel and equipment in the vicinity of the dryer drum against excessive heat. Weather seals are provided for inhibiting the entry of ambient moisture between the jacket and the outer peripheral surface of the wall of the drum.

9 Claims, 2 Drawing Sheets

HEAT LOSS REDUCTION IN ROTATING DRUM DRYERS

This is a continuation-in-part of application Ser. No. 096,740, filed Sept. 14, 1987, now U.S. Pat. No. 4,815,969.

The present invention relates generally to the reduction of heat loss in a process for manufacturing bituminous concrete asphalt and pertains, more specifically, to an improvement in drum dryers used in such processes, wherein the drum of the drum dryer is insulated against heat loss and protected against the elements of weather.

In the manufacture of bituminous concrete asphalt, sand and stone which constitute the aggregate used in the process must be heated thoroughly to ensure that all unwanted moisture is removed from these materials before the introduction of hot liquid asphalt in the process. Any such moisture could lead to a violent reaction upon exposure to the heat of the hot asphalt, thereby causing instability and adversely affecting the process.

The most common apparatus currently in use for removing such unwanted moisture is the drum dryer. In essence, the drum dryer is a large cylindrical furnace which includes a steel drum mounted for rotation about an axis inclined at a slight angle to the horizontal. The drum generally is six to eight feet in diameter and is approximately twenty to thirty feet long. A large burner is placed at one end of the drum and directs a highly concentrated flame into the interior of the drum as the raw sand and stone materials are introduced adjacent that same end. As the drum rotates, the aggregate materials are tumbled within the interior of the drum and move slowly down the incline, through the interior of the drum, to the opposite end. As the aggregate materials are heated, primarily by contact with the heated surfaces of the drum wall, all unwanted moisture is driven off. Subsequently, the hot asphalt is introduced and mixed with the dried aggregate to complete the process.

Observation of the above-described process at various bituminous concrete asphalt production facilities revealed that the greatest amount of heat lost in the process is the dissipation of heat from the outer surfaces of the dryer drum. In view of the very high temperatures involved, the construction of the apparatus, and the adverse conditions under which the drum dryers are operated, insulation of the drum was thought to be impractical. Commonly available high temperature resistant insulating materials, such as fiberglass and isocyanurate sheathing, could not withstand the necessary extended contact with the high temperature surfaces of the drum and suffered breakdown and disintegration within a relatively short period of time.

The present invention provides an arrangement by which the drum of a drum dryer used in the manufacture of bituminous concrete asphalt is successfully insulated against excessive heat loss and is protected against the elements of weather, and exhibits several objects and advantages, some of which may be summarized as follows: Realization of a dramatic decrease in heat loss resulting from the dissipation of heat from the external, or outer, surfaces of the drum, thereby attaining improved concentration of heat within the drum for more effective drying; increased economy of manufacture as a result of reduced fuel consumption per ton of bituminous concrete asphalt produced; increased efficiency of operation as a result of a reduction in warm-up time upon start-up of a production run; reduced heat loss during idle periods, with concomitant savings in fuel consumption; elimination of excessive heat in the vicinity of the drum dryer for the protection of personnel and equipment in the surrounding areas; simplicity of design and construction for ready adaptation to existing facilities, as well as to new installations; greater protection of the outer surfaces of the drum against the elements of weather, thereby reducing surface oxidation and the need for extensive maintenance, such as painting and the like; enhanced appearance of the installation; and more rugged construction for effective operation over a relatively long service life.

The above objects and advantages, as well as further objects and advantages, are accomplished by the present invention, which may be described briefly as providing, in a drum dryer for use in the manufacture of bituminous concrete asphalt, the drum dryer being of the type having a drum including a cylindrical drum wall of heat-conductive material, such as steel, having an upstream end, a downstream end a given length between the upstream end and the downstream end and a relatively large diameter, the drum wall having an outer peripheral surface, and the drum being mounted for rotation about a longitudinal axis of rotation tilted at a shallow angle to the horizontal, and a burner for directing heat into the drum adjacent the upstream end, the improvement comprising: a jacket extending essentially completely around the outer peripheral surface of the heat-conductive drum wall along at least a substantial portion of the length of the drum wall, the jacket including an outer sheath of sheet material, and a layer of ceramic fiber insulation placed between the outer sheath and the outer peripheral surface of the drum wall; and securing means for securing the jacket to the drum wall during manufacture of the bituminous concrete asphalt.

The invention will be understood more fully, while still further objects and advantages will become apparent, in the following detailed description of preferred embodiments of the invention illustrated in the accompanying drawing, in which.

Figure 1:
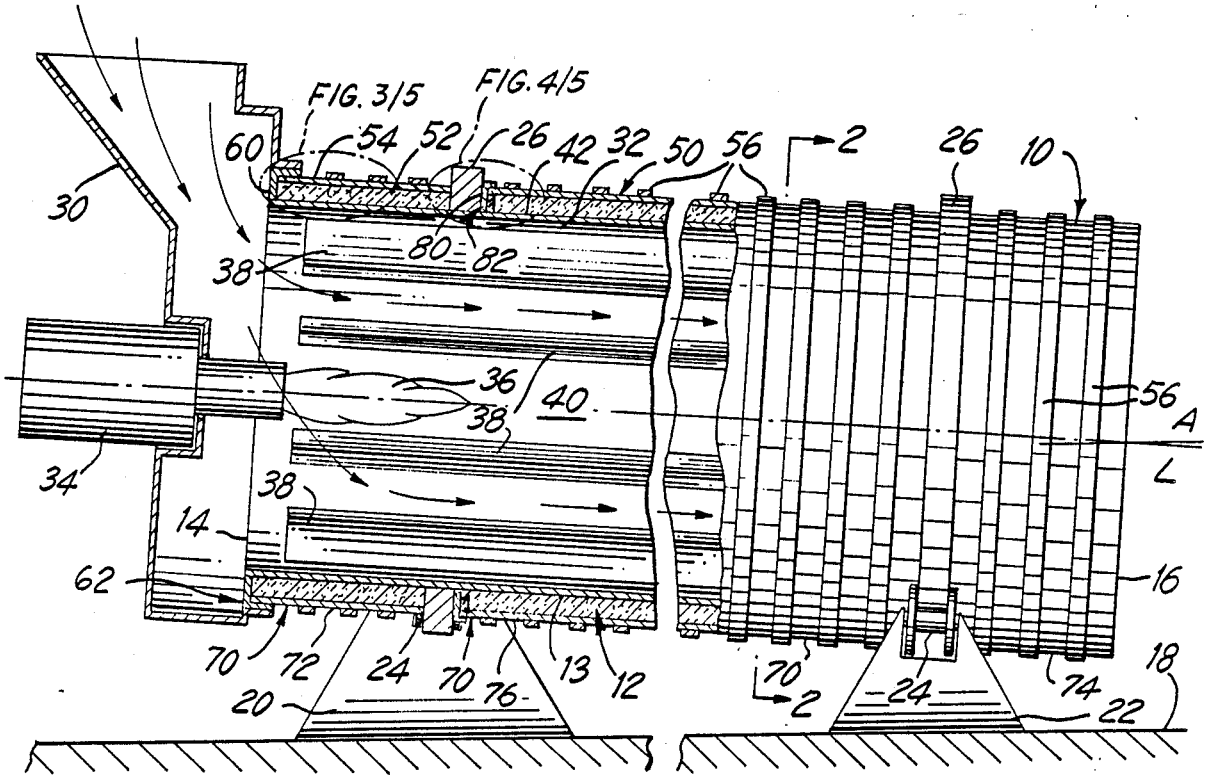
FIG. 1 is a somewhat diagrammatic, longitudinal cross-sectional view of a drum dryer constructed in accordance with the invention.
Figure 2:
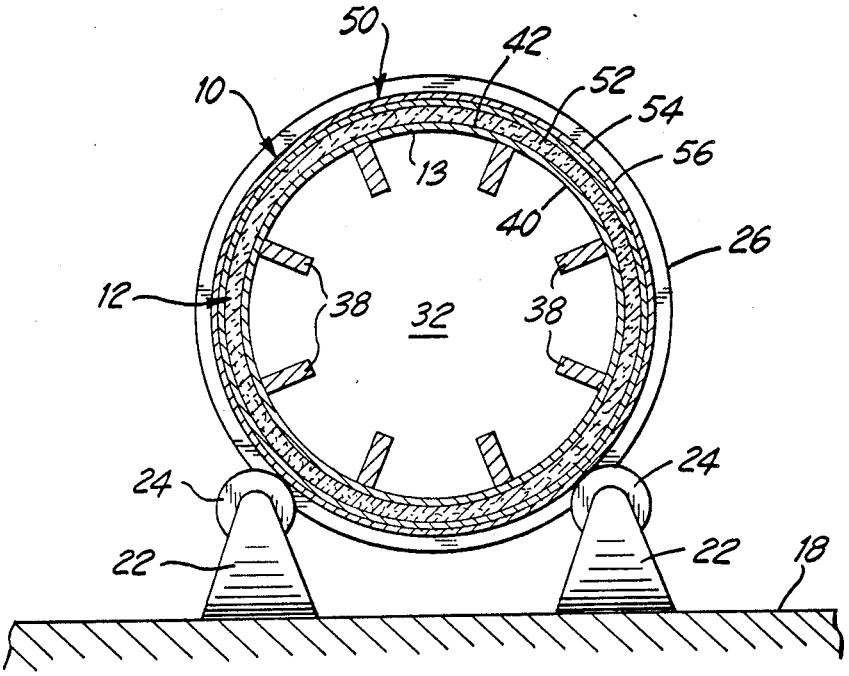
FIG. 2 is a transverse cross-sectional view taken along line 2—2 of FIG. 1.

Referring now to the drawing, and especially to FIGS. 1 and 2 thereof, a drum dryer 10 is constructed in accordance with the invention and is seen to include a drum 12 having an elongate cylindrical wall 13 extending along a longitudinal axis L between a first or upstream end 14 and a second or downstream end 16. Drum 12 is supported above ground 18 by a first support 20, located adjacent the first end 14, and a second support 22, located adjacent second end 16, and is mounted for rotation about axis L by roller assemblies 24 placed upon the supports 20 and 22 and in rolling engagement with corresponding circumferential tracks 26 carried by the drum 12. Support 20 is elevated above ground 18 slightly higher than support 22 so that axis L, and drum 12, is tilted at a shallow angle A to the horizontal, placing upstream end 14 at a slightly higher elevation than downstream end 16 of the drum 12.

In the process of manufacturing bituminous concrete asphalt, the sand and stone which make up the aggregate materials to be mixed with molten asphalt are introduced into the drum 12 at end 14 through an inlet chute 30 placed in communication with the interior 32 of drum 12 at end 14, as indicated by the arrows in FIG. 1. A burner 34 is located adjacent the upstream end 14 and directs a highly concentrated flame 36 into the interior 32 of drum 12 to heat the interior 32. Drum 12 is rotated about axis L and the aggregate materials proceed downstream within the drum 12, in the direction from upstream end 14 to downstream end 16, preferably assisted by flights 38 affixed to the inner surface 40 of the wall 13 of the drum 12 and extending along the interior 32 of the drum 12. The heat generated by burner 34 heats the interior 32 of the drum 12 and the aggregate materials, as the materials proceed downstream, and drives moisture from the aggregate materials so that upon the introduction of molten asphalt for mixing with the aggregate materials adjacent the downstream end 16 of the drum 12, the dried aggregate materials will be mixed without deleterious reaction, all in a manner now well known in the manufacture of bituminous concrete asphalt.

The wall 13 of drum 12 is constructed of steel and conducts heat readily. In conventional installations, the outer surface 42 of the wall 13 of drum 12 is exposed to the surrounding environment and heat is dissipated from the outer surface 42. The heat loss resulting from such dissipation of heat from the outer surface 42 of the drum 12 is costly, both from the standpoint of energy consumption and the need to protect personnel and equipment in the vicinity of the drum 12 from the effects of the heat emanating from the outer surface 42. In order to reduce such dissipation of heat, the present invention provides a jacket 50 which insulates the drum 12 against dissipation of heat from the outer surface 42. Jacket 50 extends essentially completely around the entire periphery of the wall 13 of drum 12, along at least a substantial portion of the length of the drum 12, and preferably along the entire length of the drum 12.

Jacket 50 includes a layer 52 of ceramic fiber insulation bonded to an outer sheath 54 of sheet metal, the sheet metal preferably being aluminum. It has been found that commonly available insulation, such as fiberglass or isocyanurate sheathing, will not withstand the temperatures and the conditions to which jacket 50 is exposed. However, the combination of ceramic fiber insulation and a sheath of sheet metal has been found to perform the desired function with reliability, as well as with effectiveness. The laminated structure of jacket 50 provides a blanket of insulation which effectively reduces to a minimum the dissipation of heat from the outer surface 42 of drum 12 which might otherwise occur by conduction, convection and radiation. Conduction and convection losses are effectively eliminated by the layer 52 of ceramic fiber insulation, while the sheath 54 reflects heat to essentially eliminate radiation losses. In addition, the sheath 54 provides rigidity and stability during both installation and use, and protects against weather and other conditions during service. The laminated structure of jacket 50 enables ease of installation, both in new construction and in the adaptation to an existing installation. Thus, jacket 50 is flexible in diametric directions and need merely be wrapped around the outer periphery of the wall 13 of drum 12 to conform the jacket 50 closely to the wall 13 of drum 12, and then is secured in place. In the illustrated embodiment, securing means are shown in the form of a plurality of bands 56 extending around the jacket 50 to secure the jacket in place. Bands 56 preferably are constructed of a tough, flexible material having the requisite strength and resistance to corrosion, such as stainless steel straps. Installation is accomplished, both in new construction and in an existing installation, without interference with the mechanism by which drum 12 is mounted for rotation about axis L.

Figure 3:
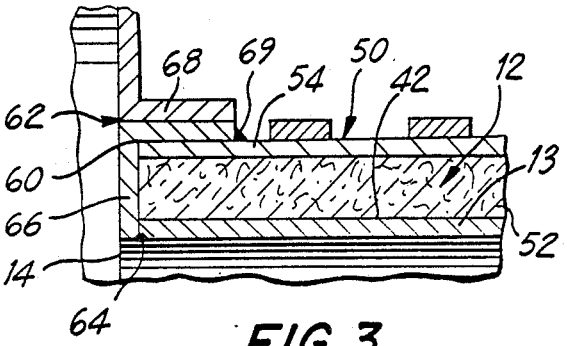
FIG. 3 is an enlarged fragmentary view of a portion of FIG. 1, as indicated in FIG. 1.

In order to protect further the outer surface 42 of the drum wall 13 from the ravages of the ambient elements of weather during service, an in particular against ambient moisture, weather seal means are provided at various locations along the length of the installation. Referring now to FIG. 3, jacket 50 is seen to have a forward end 60 adjacent the upstream end 14 of the drum 12 and weather seal means are provided between the drum wall 13 and the outer sheath 54 to inhibit the entry of ambient moisture into the jacket 50 and the access of any such moisture to the outer surface 42 of the drum wall 13. Thus, a flashing member 62 is affixed to the upstream end 14 of the drum wall 13, as by welding at 64, and includes a radial flange portion 66, which extends radially along the forward end 60 of the jacket 50, and an axial sleeve portion 68, which overlies the jacket 50 adjacent the forward end 60, both of which portions 66 and 68 have an annular configuration for extending around the entire periphery of the drum wall. Flashing member 62 is sealed further at 69, where the flashing member 62 terminates along the outer sheath 54 of the jacket 50. In this manner, the forward end 60 is sealed against the entry of deleterious moisture.

Figure 4:
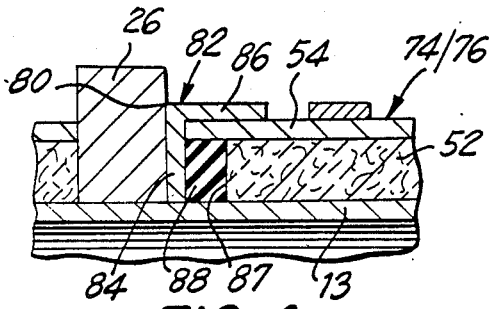
FIG. 4 is an enlarged fragmentary view of another portion of FIG. 1, as indicated in FIG. 1.

Returning now to FIG. 1, because the drum 12 is mounted for rotation by means of the circumferential tracks 26, jacket 50 is segmented so as to include a plurality of longitudinal segments 70, placed in tandem along the drum wall 13, the segments including an upstream segment 72, a downstream segment 74, and an intermediate segment 76. Upstream segment 72 is most closely adjacent the upstream end 14 of the drum 12, while downstream segment 74 and intermediate segment 76 are remote from the upstream end 14, toward the downstream end 16 of the drum wall. The forward end 60 is on the upstream segment 72 and is sealed as described above. As best seen in FIG. 4, the downstream segment 74 and the intermediate segment 76 both have a counterpart forward end 80, remote from the forward end 60, each of which forward end 80 is sealed by weather seal means provided in the form of flashing member 82 having a radial flange portion 84 extending radially adjacent the forward end 80, between the drum wall 13 and the outer sheath 54 of the jacket 50, and an axial sleeve portion 86 extending axially along and overlying the outer sheath 54. The forward end 87 of the layer 52 of ceramic fiber insulation is recessed slightly relative to the outer sheath 54 so that radial flange portion 84 is spaced axially from the layer 52, and an elastomeric sealing member 88 is interposed between the radial flange portion 84 and the forward end 87 to establish a simplified seal construction. Sealing member 88 preferably is constructed of a high temperature silicone rubber. It is noted that the simplified weather seal construction described in connection with FIG. 4 is not available for use at the forward end 60 since forward end 60 is located adjacent the upstream end 14 and consequently is heated to very high temperature, which high temperature precludes the use of an elastomeric sealing member. Forward ends 80 are remote from and are spaced longitudinally far enough away from the heated upstream end 14 so that the temperature at the elastomeric sealing member 88 is low enough to enable use of the simplified construction which utilizes an elastomeric sealing member 88 at those locations.

Figure 5:
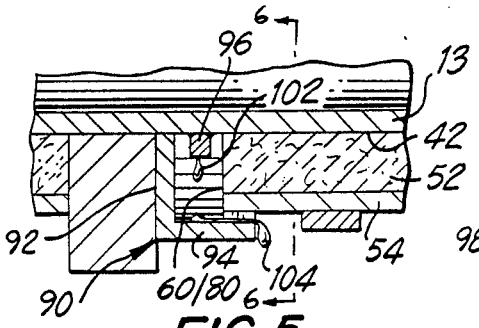
FIG. 5 is an enlarged fragmentary view illustrating an alternate construction and shown in connection with an indicated portion of FIG. 1.
Figure 6:
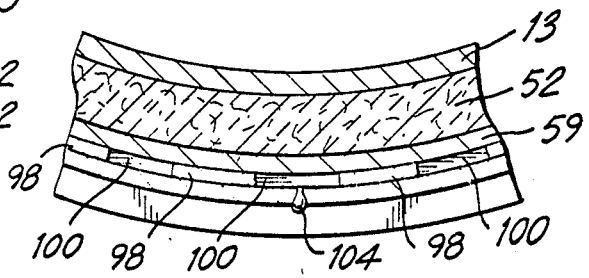
FIG. 6 is an enlarged fragmentary end view of the alternate construction illustrated in FIG. 5, taken along line 6—6 of FIG. 5.

Turning now to FIGS. 5 and 6, an alternate construction for the weather seal means at each of the forward ends 60 and 80 includes a flashing member 90 having a radial flange portion 92 spaced axially from the respective forward end 60 or 80 and an axial sleeve portion 94 which extends axially over the forward end and overlies the outer sheath 54 of the jacket 50. A drip bar 96 is affixed to the outer surface 42 of the drum wall 13, as by welding, intermediate the respective forward end 60 or 80 and the radial flange portion 92 of the flashing member 90. Drip bar 96 preferably is in the form of an annular bar having a rectangular cross-sectional configuration and extends around the entire periphery of the outer surface 42 of drum 12. A plurality of spacers 98 are interposed between corresponding portions of the axial sleeve portion 94 of the flashing member 90 and the outer sheath 54 to establish weep passages 100. Any moisture which may enter between the flashing member 90 and the forward end 60 or 80, will be diverted by the drip bar 96 and will drip from the drip bar 96, as illustrated at 102, to drain through the weep passages 100, as seen at 104. In this manner, moisture effectively is inhibited from proceeding downstream along the outer surface 42 with a weather seal construction which can withstand the temperatures encountered at any of the locations along the drum 12.

Figure 7:
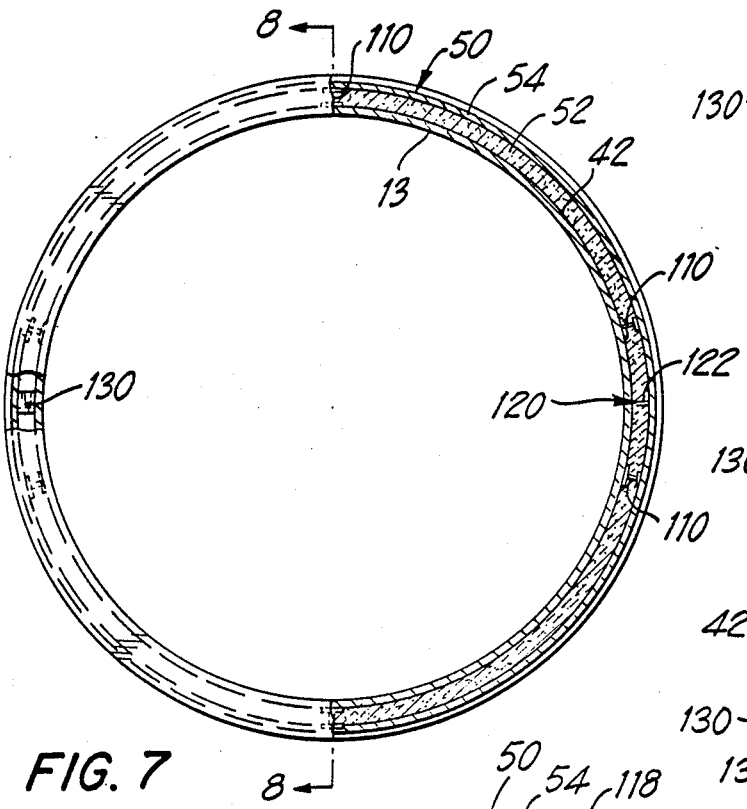
FIG. 7 is a view of the upstream end of the drum of the drum dryer, partially sectioned.
Figure 8:
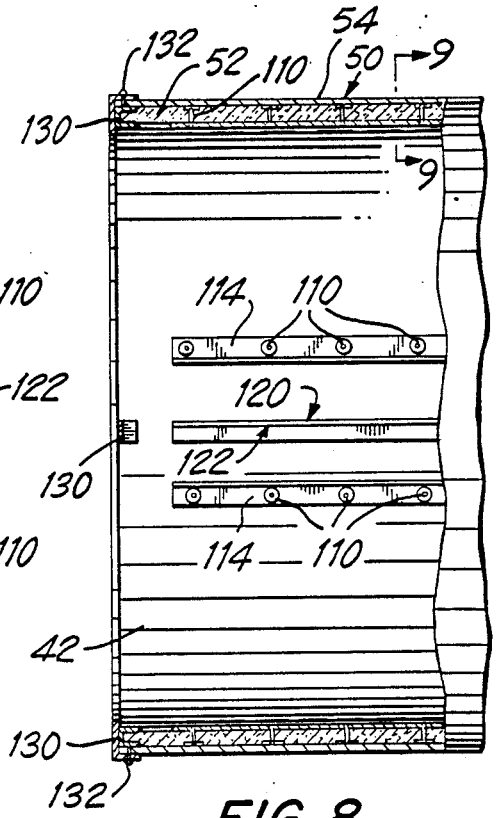
FIG. 8 is a fragmentary side elevational view of the drum, partially sectioned along line 8—8 of FIG. 7.
Figure 9:
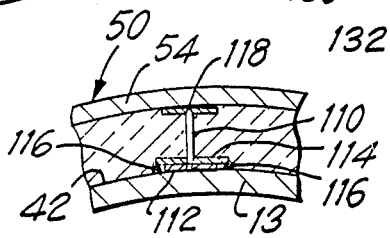
FIG. 9 is an enlarged fragmentary cross-sectional view taken along line 9—9 of FIG. 8.

As best seen in FIGS. 7, 8 and 9, jacket 50 preferably is fixed against movement relative to the drum wall 13 by anchoring means shown in the form of projections 110 affixed to the outer surface 42 of the drum wall 13 and extending into the jacket 50 to engage the layer 52 of ceramic fiber insulation and inhibit movement of the jacket 50 in directions transverse to the projections 110. The projections 110 are shown in the form of pin-like members which are integral with a head 112 at one end, the heads 112 being located beneath a strip 114 affixed to the outer surface 42 of the drum wall 13, as by welding at 116. A disk-like retainer 118 is secured to each projection 110, adjacent the end opposite the head 112, and engages the layer 52 of ceramic fiber insulation to restrain movement of the layer 52 away from the outer surface 42 of the drum wall 13 in directions normal to the drum wall. Also affixed to the outer surface 42 of the drum wall 13 are angles 120 which include longitudinal fin portions 122 extending essentially normal to the outer surface 42 and into the layer 52 for restraining movement of the layer 52, and the jacket 50, in circumferential directions relative to the drum wall 13. In addition, a plurality of C-shaped brackets 130 are welded to the outer surface 42 of the drum wall 13 at circumferentially spaced apart locations and are fastened to the outer sheath 54, as by the use of rivets 132, to secure further the outer sheath 54 and the jacket 50 against unwanted movement relative to the drum wall 13.

In a typical installation in which the drum 12 has a diameter of eight feet and a length of thirty feet, the heat loss from the outer surface 42 due to radiation alone amounts to almost 1.6 million BTU per hour. A layer 52 of ceramic fiber insulation having a thickness of only about 1.5 inches bonded to an outer sheath 54 of aluminum having a thickness of about 0.030 inch is sufficient to essentially eliminate heat loss from the outer surface 42 due to radiation. Over eight hours of operation per day, such a reduction in heat loss results in the conservation of approximately fifteen to twenty-five percent of the normal fuel oil consumption during each day of operation. Thus, it can be seen that the relatively simple addition of jacket 50 results in a considerable saving of energy. Jacket 50 provides and economical arrangement which not only is effective in conserving energy, but is rugged enough to withstand the conditions encountered in the manufacture of bituminous concrete asphalt over a long service life. In addition, the outer surface 42 is protected against the elements of weather, thereby reducing surface oxidation and the need for extensive maintenance, such as painting and the like. Further, the jacket 50 provides an enhanced, aesthetically pleasing appearance to the installation.

It is to be understood that the above detailed description of preferred embodiments of the invention is provided by way of example only. Various details of design and construction may be modified without departing from the true spirit and scope of the invention as set forth in the appended claims.

The embodiments of the invention in which an exclusive property or privilege is claimed are defined as follows:

1. In a drum dryer for use in the manufacture of bituminous concrete asphalt, the drum dryer being of the type having a drum including a cylindrical drum wall of heat-conductive material, such as steel, having an upstream end, a downstream end, a given longitudinal length between the upstream end and the downstream end and a relatively large diameter, the drum wall having an outer peripheral surface, and the drum being mounted for rotation about a longitudinal axis of rotation tilted at a shallow angle to the horizontal, and a burner for directing heat into the drum adjacent the upstream end, the improvement comprising:

a jacket extending essentially completely around the outer peripheral surface of the heat-conductive drum wall along at least a substantial portion of the length of the drum wall, the jacket including an outer sheath of sheet material, and a layer of ceramic fiber insulation placed between the outer sheath and the outer peripheral surface of the drum wall, the jacket having a forward end adjacent the upstream end of the drum wall;

securing means for securing the jacket to the drum wall during manufacture of the bituminous concrete asphalt; and weather seal means extending between the drum wall and the outer sheath of the jacket at the forward end of the jacket for inhibiting the entry of ambient moisture between the jacket and the outer peripheral surface of the drum wall, the weather seal means including a flashing member having a radial flange portion extending radially adjacent the forward end of the jacket and an axial sleeve portion extending axially along and overlying the jacket adjacent the forward end.

2. The invention of claim 1 wherein the radial flange portion of the flashing member is spaced longitudinally from the forward end of the jacket, and the weather seal means includes a drip bar on the outer peripheral surface of the drum wall between the radial flange portion and the forward end of the jacket, and weep passages in the weather seal means for enabling water dripped from the drip bar to drain from the weather seal means.

3. The invention of claim 2 wherein the axial sleeve portion of the flashing member includes at least portions spaced radially from corresponding portions of the outer sheath of the jacket, said weep passages being located between said corresponding portions of the axial sleeve portion and the outer sheath.

4. In a drum dryer for use in the manufacture of bituminous concrete asphalt, the drum dryer being of the type having a drum including a cylindrical drum wall of heat-conductive material, such as steel, having an upstream end, a downstream end, a given longitudinal length between the upstream end and the downstream end and a relatively large diameter, the drum wall having an outer peripheral surface, and the drum being mounted for rotation about a longitudinal axis of rotation tilted at a shallow angle to the horizontal, and a burner for directing heat into the drum adjacent the upstream end, the improvement comprising:

a jacket extending essentially completely around the outer peripheral surface of the heat-conductive drum wall along at least a substantial portion of the length of the drum wall, the jacket including an outer sheath of sheet material, and a layer of ceramic fiber insulation placed between the outer sheath and the outer peripheral surface of the drum wall;

securing means for securing the jacket to the drum wall during manufacture of the bituminous concrete asphalt;

the jacket including a plurality of longitudinal segments placed in tandem along the outer peripheral surface of the drum wall, each segment having a forward end nearest the upstream end of the drum wall; and weather seal means extending between the drum wall and the outer sheath of the jacket at the forward end of each segment of the jacket for inhibiting the entry of ambient moisture between the jacket and the outer peripheral surface of the drum wall.

5. The invention of claim 4 wherein the weather seal means at the forward end of at least one of the segments of the jacket includes a flashing member having a radial flange portion extending radially adjacent the forward end of the one segment of the jacket and an axial sleeve portion extending axially along and overlying the segment of the jacket adjacent the forward end, the radial flange portion of the flashing member is spaced longitudinally from the forward end of the segment of the jacket, and the weather seal means includes a drip bar on the outer peripheral surface of the drum wall between the radial flange portion and the forward end of the segment of the jacket, and weep passages in the weather seal means for enabling water dripped from the drip bar to drain from the weather seal means.

6. The invention of claim 5 wherein the axial sleeve portion of the flashing member includes at least portions spaced radially from corresponding portions of the outer sheath of the jacket, said weep passages being located between said corresponding portions of the axial sleeve portion and the outer sheath.

7. The invention of claim 4 wherein the weather seal means at the forward end of at least one of the segments of the jacket remote from the upstream end of the drum wall includes a flashing member having a radial flange portion extending radially adjacent the forward end of the one segment of the jacket and an axial sleeve portion extending axially along and overlying the segment of the jacket adjacent the forward end, the radial flange portion of the flashing member is spaced longitudinally from the forward end of the segment of the jacket, and the weather seal means includes an elastomeric sealing member located between the flange portion of the flashing member and the end of the layer of ceramic insulating material corresponding to the forward end of the one remote segment.

8. In a drum layer for use in the manufacture of bituminous concrete asphalt, the drum dryer being of the type having a drum including a cylindrical drum wall of heat-conductive material, such as steel, having an upstream end, a downstream end, a given longitudinal length between the upstream end and the downstream end and a relatively large diameter, the drum wall having an outer peripheral surface, and the drum being mounted for rotation about a longitudinal axis of rotation tilted at a shallow angle to the horizontal, and a burner for directing heat into the drum adjacent the upstream end, the improvement comprising:

a jacket extending essentially completely around the outer peripheral surface of the heat-conductive drum wall along at least a substantial portion of the length of the drum wall, the jacket including an outer sheath of sheet material, and a layer of ceramic fiber insulation placed between the outer sheath and the outer peripheral surface of the drum wall;

securing means for securing the jacket to the drum wall during manufacture of the bituminous concrete asphalt; and anchoring means affixed to the outer peripheral surface of the drum wall and projecting radially outwardly into the layer of ceramic fiber insulation for inhibiting movement of the layer relative to the outer peripheral surface of the drum wall, the anchoring means including a plurality of projections affixed to the drum wall and extending into the layer of ceramic fiber insulation, and disk-like retainers secured to the projections at locations spaced radially from the outer peripheral surface of the drum wall, with the disk-like retainers engaging the ceramic fiber insulation of the layer to restrain the layer against movement radially outwardly away from the drum wall.

9. In a drum dryer for use in the manufacture of bituminous concrete asphalt, the drum dryer being of the type having a drum including a cylindrical drum wall of heat-conductive material, such as steel, having an upstream end, a downstream end, a given longitudinal length between the upstream end and the downstream end and a relatively large diameter, the drum wall having an outer peripheral surface, and the drum being mounted for rotation about a longitudinal axis of rotation tilted at a shallow angle to the horizontal, and a burner for directing heat into the drum adjacent the upstream end, the improvement comprising:

a jacket extending essentially completely around the outer peripheral surface of the heat-conductive drum wall along at least a substantial portion of the length of the drum wall, the jacket including an outer sheath of sheet material, and a layer of ceramic fiber insulation placed between the outer sheath and the outer peripheral surface of the drum wall;

securing means for securing the jacket to the drum wall during manufacture of the bituminous concrete asphalt; and anchoring means affixed to the outer peripheral surface of the drum wall and projecting radially outwardly into the layer of ceramic fiber insulation for inhibiting movement of the layer relative to the outer peripheral surface of the drum wall, the anchoring means including at least one angle affixed to the drum wall and having a longitudinally-extending fin portion projecting radially outwardly into the layer of ceramic fiber insulation to restrain the layer against movement in circumferential directions relative to the drum wall.

* * * * *